US008291520B2

(12) United States Patent
Lukens

(10) Patent No.: US 8,291,520 B2
(45) Date of Patent: Oct. 23, 2012

(54) HEADGEAR

(75) Inventor: Thomas M. Lukens, Bellevue, WA (US)

(73) Assignee: Asics Corporation, Kobe (JP)

( * ) Notice: Subject to any disclaimer, the term of this patent is extended or adjusted under 35 U.S.C. 154(b) by 211 days.

(21) Appl. No.: 12/795,233

(22) Filed: Jun. 7, 2010

(65) Prior Publication Data

US 2011/0296595 A1 Dec. 8, 2011

(51) Int. Cl.
*A42B 3/16* (2006.01)
*A63B 71/10* (2006.01)
*A42B 1/06* (2006.01)

(52) U.S. Cl. ..... 2/423; 2/425; 2/412; 2/421; 2/209; 2/312

(58) Field of Classification Search ..... 2/423, 425, 2/411, 412, 209, 421, 312
See application file for complete search history.

(56) References Cited

U.S. PATENT DOCUMENTS 2,898,596 A * 8/1959 Keen ..... 2/421
3,311,921 A 4/1967 Lee
3,327,316 A * 6/1967 Pukish, Jr. ..... 2/421
3,454,962 A 7/1969 Hind
3,513,482 A * 5/1970 Holden ..... 2/421
3,594,815 A 7/1971 Reese
3,596,288 A * 8/1971 Marchello ..... 2/421
3,628,191 A 12/1971 Douglas
4,279,037 A * 7/1981 Morgan ..... 2/421
4,551,861 A * 11/1985 Marchello ..... 2/425
4,706,305 A 11/1987 Cho
4,710,985 A * 12/1987 Dubner et al. ..... 2/425
4,754,501 A * 7/1988 Yahn ..... 2/424
4,821,345 A * 4/1989 Marchello ..... 2/425
5,177,815 A 1/1993 Andujar
5,228,143 A 7/1993 Marchello
5,361,420 A * 11/1994 Dobbs et al. ..... 2/425
5,500,951 A * 3/1996 Marchello ..... 2/455
5,504,945 A * 4/1996 Purnell ..... 2/425
5,685,021 A * 11/1997 Tsujino ..... 2/425
5,881,393 A * 3/1999 Marchello ..... 2/425
6,058,516 A * 5/2000 Purnell ..... 2/425
6,279,160 B1 * 8/2001 Chen ..... 2/24
6,289,522 B1 * 9/2001 Jones et al. ..... 2/425
6,381,760 B1 * 5/2002 Lampe et al. ..... 2/425
6,418,565 B1 * 7/2002 Tsujino ..... 2/425
D469,928 S * 2/2003 Keen et al. ..... D29/112
6,557,186 B1 * 5/2003 Purnell ..... 2/425
6,564,395 B2 * 5/2003 Keen ..... 2/425
6,715,156 B1 4/2004 Purnell
6,782,558 B1 * 8/2004 Keen et al. ..... 2/425
D500,894 S * 1/2005 Coutant et al. ..... D29/106
6,986,167 B1 * 1/2006 Coutant et al. ..... 2/425
7,152,253 B2 * 12/2006 Abelman et al. ..... 2/421
7,197,773 B2 * 4/2007 Purnell ..... 2/425
D547,909 S * 7/2007 Purnell ..... D29/122
D547,910 S * 7/2007 Purnell ..... D29/122

(Continued)

*Primary Examiner* — Bobby Muromoto, Jr.
(74) *Attorney, Agent, or Firm* — Mintz Levin Cohn Ferris Glovsky and Popeo, P.C.

(57) ABSTRACT

The headgear has right and left symmetrical earguard assemblies with an earguard pad and protective shell that are detachable from each other. A plurality of detachable head straps join each earguard assembly to prevent separation of the pad and shell of each earguard assembly. The periphery of each protective shell is surrounded and embraced by peripheral wall portions on the pads to align the respective shells on the respective earguard pads in an alignment position. Corresponding engageable protrusions and recesses on the pads and shells also help maintain the alignment position.

20 Claims, 14 Drawing Sheets

U.S. PATENT DOCUMENTS

| | | | | |
|---|---|---|---|---|
| 7,237,270 | B2 * | 7/2007 | Crye et al. | 2/24 |
| D548,404 | S * | 8/2007 | Purnell | D29/112 |
| D548,405 | S * | 8/2007 | Purnell | D29/122 |
| D551,393 | S * | 9/2007 | Purnell | D29/112 |
| D551,809 | S * | 9/2007 | Purnell | D29/122 |
| D553,803 | S * | 10/2007 | Keen | D29/112 |
| 7,464,414 | B2 | 12/2008 | McDuff | |
| D616,609 | S * | 5/2010 | Copeland | D29/112 |
| D622,006 | S * | 8/2010 | Copeland | D29/112 |
| D629,569 | S * | 12/2010 | Copeland | D29/112 |
| D634,897 | S * | 3/2011 | Lukens | D29/112 |
| 2002/0002733 | A1 * | 1/2002 | Keen | 2/425 |
| 2002/0083512 | A1 | 7/2002 | Tsujino | |
| 2006/0143806 | A1 * | 7/2006 | Purnell | 2/425 |

* cited by examiner

HEADGEAR

BACKGROUND OF THE INVENTION

1. Field of the Invention

This invention relates to a headgear for protecting the ears of athletes, especially in the sport of wrestling and more particularly to a headgear of relatively few parts that permits simple assembly, easy adjustment and provides a comfortable fit with enhanced release of perspiration at the ear protection area, and good sound reception.

2. Prior Art

U.S. Pat. No. 2,886,818 to Roberts shows earguards with an inner rubber portion riveted to a rigid convex shell.

U.S. Pat. No. 2,898,596 to Keen shows a headgear with earguards that include a rigid inner shell covered by a soft foam-like material.

U.S. Pat. No. 3,311,921 to Helm shows wrestling headgear with a rigid shell having central ventilation openings and a peripheral pad riveted to the periphery of the shell.

U.S. Pat. No. 3,327,316 to Pukish, Jr. shows a wrestling headgear with head and chin straps that are stitched to the right and left ear covers.

U.S. Pat. No. 3,513,482 to Holden shows a wrestling headgear with straps that pass through loops that are riveted to each ear cover.

U.S. Pat. No. 3,541,611 to Beguin shows ear cups attached to a head harness by straps that pass through a pivotal mounting ring within the ear cup.

U.S. Pat. Nos. 3,596,288 to Marchello; 3,628,191 to Douglas; 4,551,861 to Marchello; 4,710,985 to Dubner et al; 4,706,305 to Cho; and 5,500,951 to Marchello show head straps formed as a continuation of the earguard.

U.S. Pat. No. 4,279,037 to Morgan shows a headgear that includes a cover portion for the forehead.

U.S. Pat. Nos. 4,821,345 to Marchello and 5,504,945 to Purnell show a headgear with strap ends disposed between a soft outer layer and a rigid inner shell.

U.S. Pat. No. 5,177,815 to Anduiar shows a headgear formed of resilient foam and pad members to protect the wearer from forceful blows to the head.

U.S. Pat. No. 5,228,143 to Marchello shows an earguard assembly with a peel off inside pad to facilitate cleaning of the earguard.

U.S. Pat. No. 5,361,420 to Dobbs et al shows a headgear for wrestlers that covers the entire head and ears.

U.S. Pat. No. 5,881,393 to Marchello shows a headgear with adjustment straps and ear cover members that include a relatively hard plastic outer layer and an inner soft foam liner that are integrally joined together.

U.S. Pat. No. 6,058,516 to Purnell shows a wrestling headgear with earpieces that have integrally joined Velcro adjustment straps.

U.S. Pat. No. 6,418,565 to Tsujino and U.S. Pat. No. 6,557,186 to Purnell show a wrestling headgear with adjustment straps that pass through openings in one member of a multi-member earguard.

U.S. Pat. No. 6,564,395 to Keen shows a headgear with straps that pass through D-rings on the right and left ear covers, the D-rings being attached to each ear cover.

U.S. Pat. No. 6,715,156 to Purnell shows a headgear with strap portions that are integral with left and right side ear protectors.

U.S. Pat. No. 6,782,558 to Keen shows a wrestler's headgear wherein right and left ear cover assemblies include a soft inner cushion and a plastic outer shell that are held in place by headstraps.

U.S. Pat. No. 6,986,167 to Coutant shows a headgear with component portions of the earguards integrally joined together.

U.S. Pat. No. 7,197,773 to Purnell shows a wrestling headgear with ear covers that include two relatively rigid members that snap together and receive a foam inner pad.

U.S. Design Pat. Nos. D 469,928; D 476,450; and D 553,803 to Keen et al. show various designs for a wrestler headgear or components thereof.

U.S. Design Pat. Nos. D 548,404 and D 551,393 to Purnell show designs for a wrestler headgear.

Some common problems with known headgear of the type previously discussed is that they may be difficult to adjust or assemble, or if assembly is simplified the component parts may shift with respect to each other after adjustment. A further problem with known headgear is that they can muffle outside sound, which is discomforting to the wearer. Also, in many known headgear, perspiration accumulates around the ears within the earguard, which can cause slippage of the earguards on the head during wrestling activity.

Earguard slippage is distracting to the wrestler and can compromise ear protection, obstruct the wearer's vision and lead to temporary stoppage of a wrestling match while the headgear is repositioned on the wearer's head.

It is thus desirable to provide a headgear that is comfortable to wear, has good sound transmission, permits enhanced release of perspiration from around the ears and is thus relatively slip resistant on the head. It is also desirable to provide a headgear of simplified construction that is easy to assemble and disassemble, and adjust into a comfortable position on the head that is positionally stable. It is further desirable to provide a headgear with few parts that does not require permanent or complex assembly of the components by bonding, riveting, gluing, and the like to form a stable integral unit.

In accordance with the present invention, each earguard of the headgear includes a separate inner earguard pad and a separate outer protective shell with mating recesses and projections. The pads and shells are easily assembled together with detachable head straps, provided at the head and neck area, and a chin strap to form a positionally stable earguard assembly. It will be noted that head straps provided at the neck area are occasionally referred to as neck straps in this description. The headgear can also be easily disassembled into its component parts when desired.

The headgear includes a right earguard assembly and a left earguard assembly that are symmetrical. Each earguard assembly includes an inner earguard pad and an outer protective shell detachable from each other, a plurality of elongated head straps extending from one of the earguard assemblies to the other earguard assembly detachably joined to the right and left earguard assemblies to prevent detachment of the inner earguard pad and the outer protective shell of each earguard assembly. Each protective shell has a predetermined peripheral shape including a first corresponding plurality of peripheral lobes, and each earguard pad is formed with a second corresponding plurality of lobe-like peripheral wall portions that surround and embrace the peripheral lobes of the protective shell to align the respective outer protective shells on the respective earguard pads in respective predetermined alignment positions.

Each protective shell has an irregular asymmetric peripheral shape, and each earguard pad is formed with an irregular asymmetric peripheral wall of complementary shape and size with respect to the irregular asymmetric peripheral shape of the protective shell such that the irregular asymmetric peripheral wall of the earguard pad surrounds and embraces the irregular asymmetric periphery of the protective shell to align the earguard pad and protective shell in the earguard assembly.

Each protective shell includes peripheral sections that extend between selected pairs of peripheral lobes and each earguard pad includes supplemental wall portions that engage the peripheral sections of the respective protective shells when the respective protective shells and the respective earguard pads are in their respective predetermined aligned positions, to enhance the positional stability of the protective shells on the earguard pads in the respective aligned positions.

Each protective shell has an outer surface and the peripheral lobes have a radially outer peripheral edge. The outer surface is formed with channels that extend from the slot-like openings in the peripheral lobes to the radially outer peripheral edge to accommodate the straps.

Each protective shell and each earguard pad are provided with a corresponding plurality of slot-like openings that respectively align when the protective shell and the earguard pad are in their aligned positions in the earguard assembly. The slot-like openings are provided in the peripheral lobes of the protective shell, and each earguard pad is formed with corresponding slot-like openings that align with the slot-like openings in the respective protective shells when the protective shells and the earguard pads are in their respective predetermined alignment positions.

At least one of the earguard pads include supplemental wall portions that engage the periphery of at least one of the protective shells between selected pairs of peripheral lobes on the at least one protective shell.

Each earguard pad has an inner surface and an inner surface outer periphery. The inner surface of the earguard pad is formed with channels extending from the slot-like openings in the earguard pads to the inner surface outer periphery of the earguard pads, to accommodate the straps.

Each earguard pad has a channel formed in the lobe-like peripheral wall portions in alignment with the channels in the outer surface of the protective shells.

Each earguard pad has an outer surface formed with a select number of spaced alignment bosses that protrude outwardly from the outer surface and each protective shell includes a corresponding number of openings aligned with the respective alignment bosses to receive the alignment bosses when the respective outer protective shells and the respective earguard pads are in their respective alignment positions to enhance the positional stability of the protective shell on the earguard pad in the aligned position The head straps include means for adjusting and maintaining selected individual lengths of the respective straps between the right and left earguard assemblies.

The head straps have opposite ends and an upper surface and an under surface that includes a first set of hook and loop fastening means at the under surface of the strap such that entry of one end of one head strap initially through the shell slot and then into the earguard slot of one of the earguard assemblies permit hook and loop attachment at the under surface of the one head strap. The head strap further includes a second set of hook and loop fastening means at the upper surface of the strap such that entry of the opposite end of the head strap initially through the earpad slot and then into the shell slot of the other earguard assembly permit hook and loop attachment at the upper surface of the head strap.

The plurality of peripheral lobes in each protective shell corresponds to the plurality of head straps, and the corresponding plurality of lobe-like peripheral wall portions in the earguard pad surround and embrace the peripheral lobes to align the outer protective shell on the earguard pad in a predetermined alignment position.

The outer protective shell can be made of any suitable material that is sufficiently rigid to protect the ear of the wearer of the headgear, and is preferably a plastic material such as low density polyethylene. The inner earguard pad and the outer plastic protective shell are constructed such that the outer plastic shell mates with minimal slippage with respect to the inner earguard pad to form the earguard assembly.

Each of the earguards have slots or openings near the periphery of the earguard to releasably accommodate the head straps, neck straps and chin strap. All straps are individually adjustable to enable the headgear to be easily custom fitted onto the head and over the ears of the wearer.

Adjustability and assembly of the earguard components is preferably accomplished with hook and loop connections (such as sold under the trademark Velcro) at opposite end positions of the head, neck and chin straps. The head and neck straps pass through aligned openings near the periphery of the earguard pad and the earguard shell, to secure the pads and shells together and thus form the headgear.

The outer plastic protective shell can be manufactured by processes well known in the art, such as, for example, by injection molding, casting and other equivalent procedures, from suitable materials such as low density polyethylene and other equivalent materials.

The inner earguard pads can be manufactured by processes well known in the art, such as, for example, injection molding, casting, and other equivalent procedures well known in the art, from such suitable materials as compressed energy absorbing foam and other equivalent materials well known in the art.

BRIEF DESCRIPTION OF THE DRAWINGS

In the accompanying drawings.

Corresponding reference numbers indicate corresponding parts throughout the several views of the drawings.

DETAILED DESCRIPTION OF THE INVENTION

Figure 1:
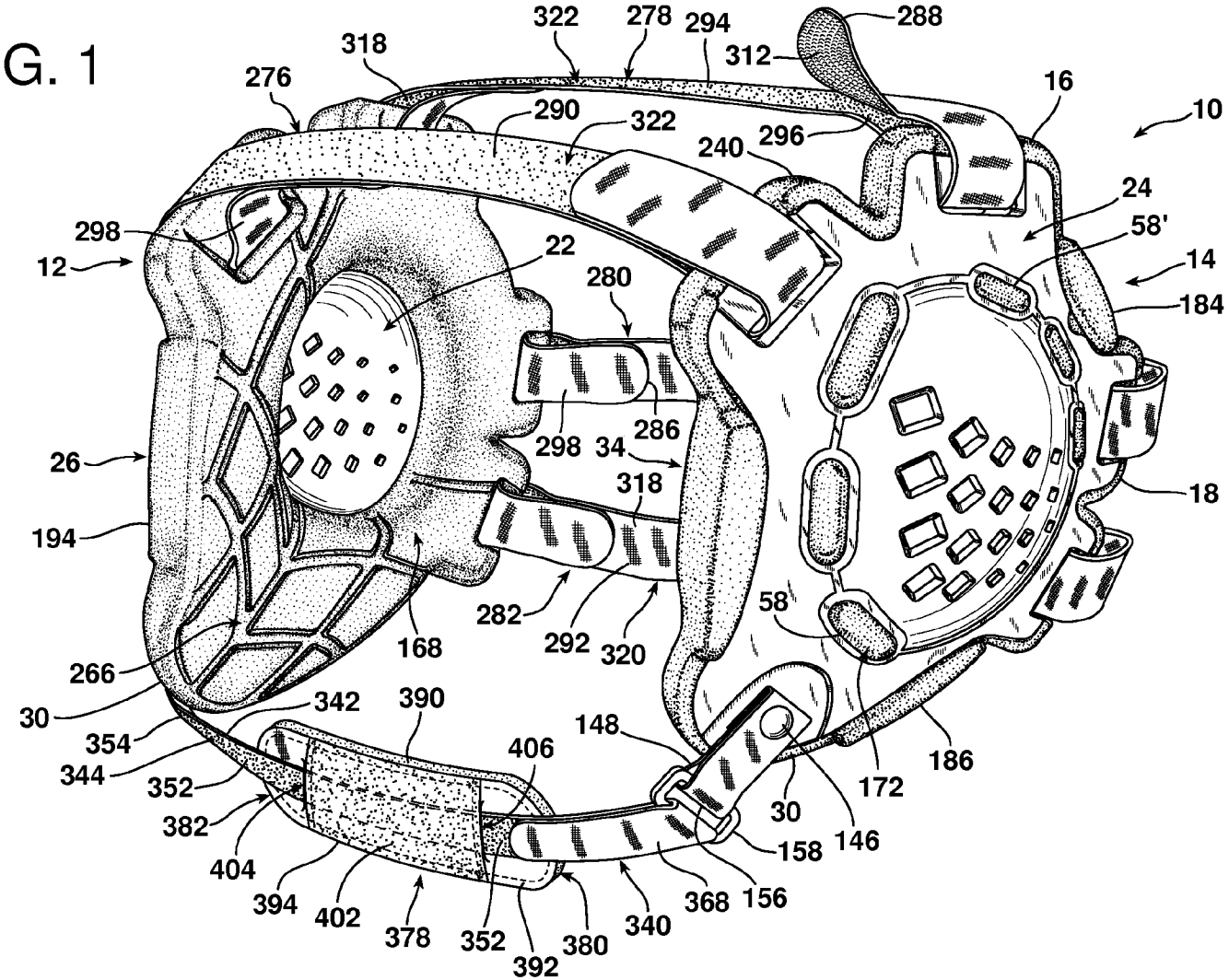
FIG. 1 is a perspective view of a headgear incorporating one embodiment of the invention.
Figure 2:
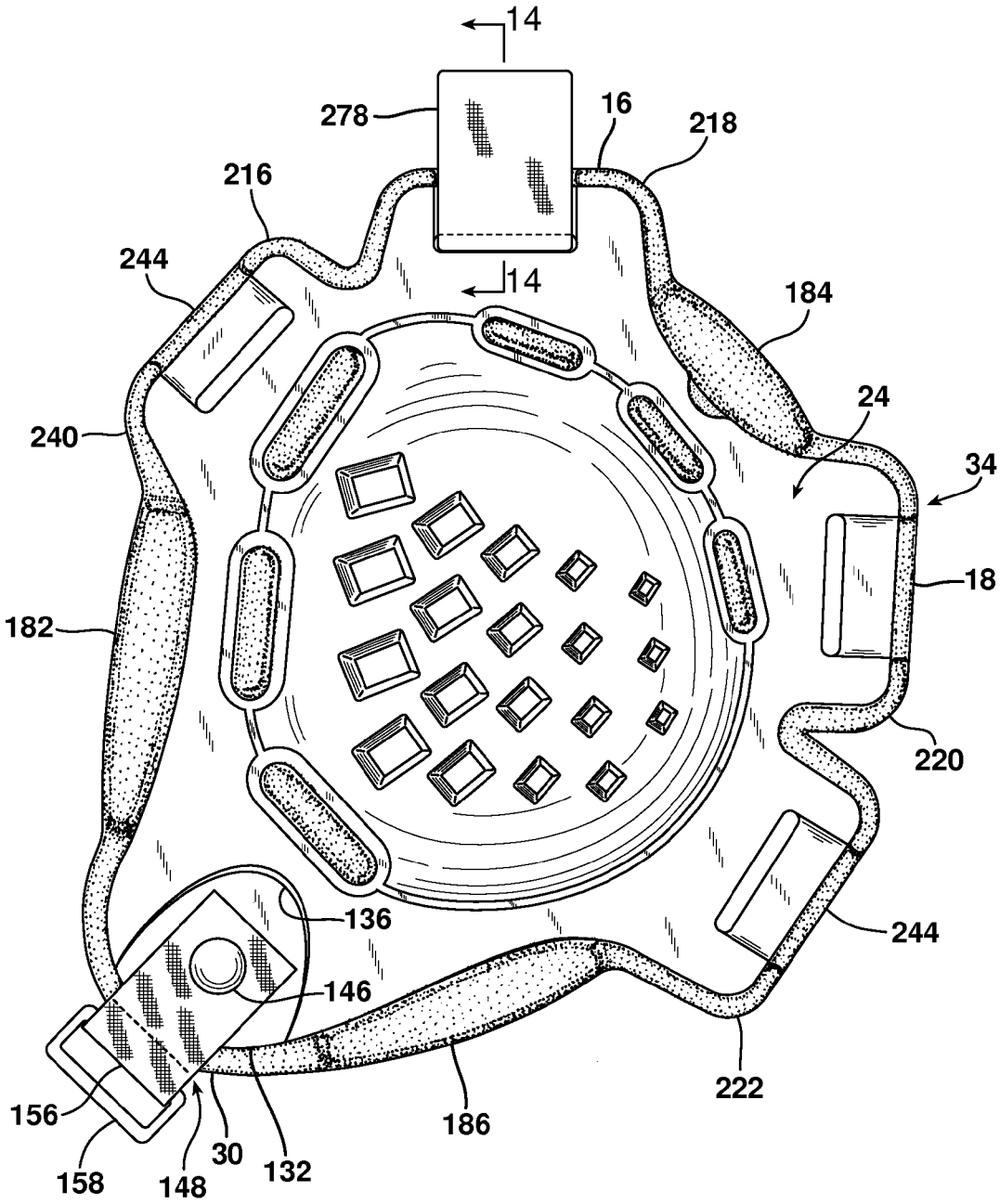
FIG. 2 is an outside side view of the left earguard thereof with some straps removed for purposes of clarity.

Referring to the drawings, a headgear incorporating one embodiment of this invention is generally indicated by the reference number 10 in FIG. 1. The headgear 10 includes a right earguard 12 and a left earguard 14 which are substantially mirror images of each other. The right earguard 12 and the left earguard 14 each include a top portion 16, a rear portion 18 and a bottom portion 30 (FIG. 2).

As shown in FIG. 1, the right and left earguards 12 and 14, are symmetrical, with right and left plastic ear protection shells 22 and 24 that are generally concave at the inside and generally convex at the outside. The earguards 12 and 14 also include symmetrical right and left resilient ear protection pads 26 and 34.

Figure 7:
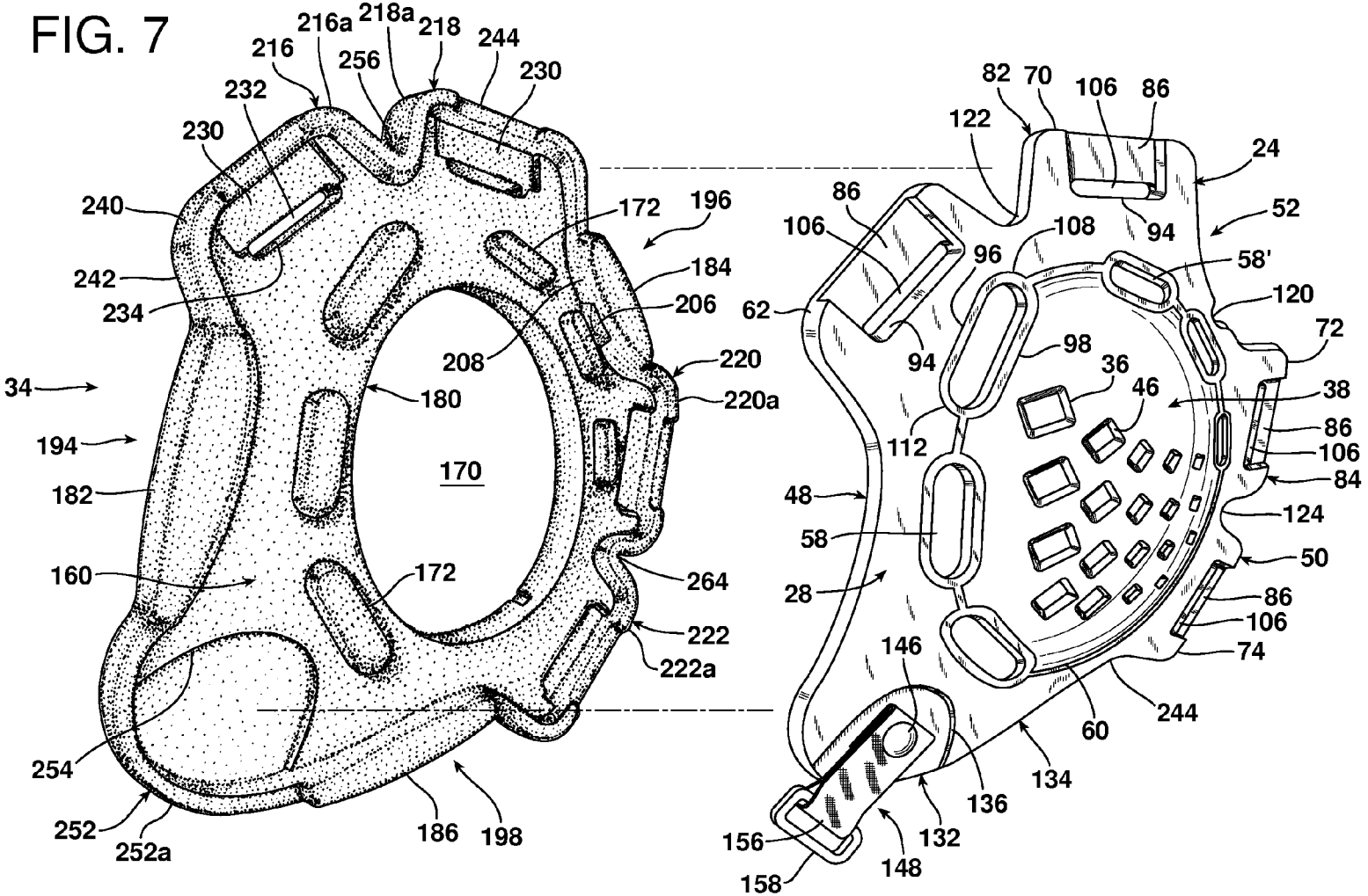
FIG. 7 is an exploded perspective view of the left earguard of FIG. 3.
Figure 9:
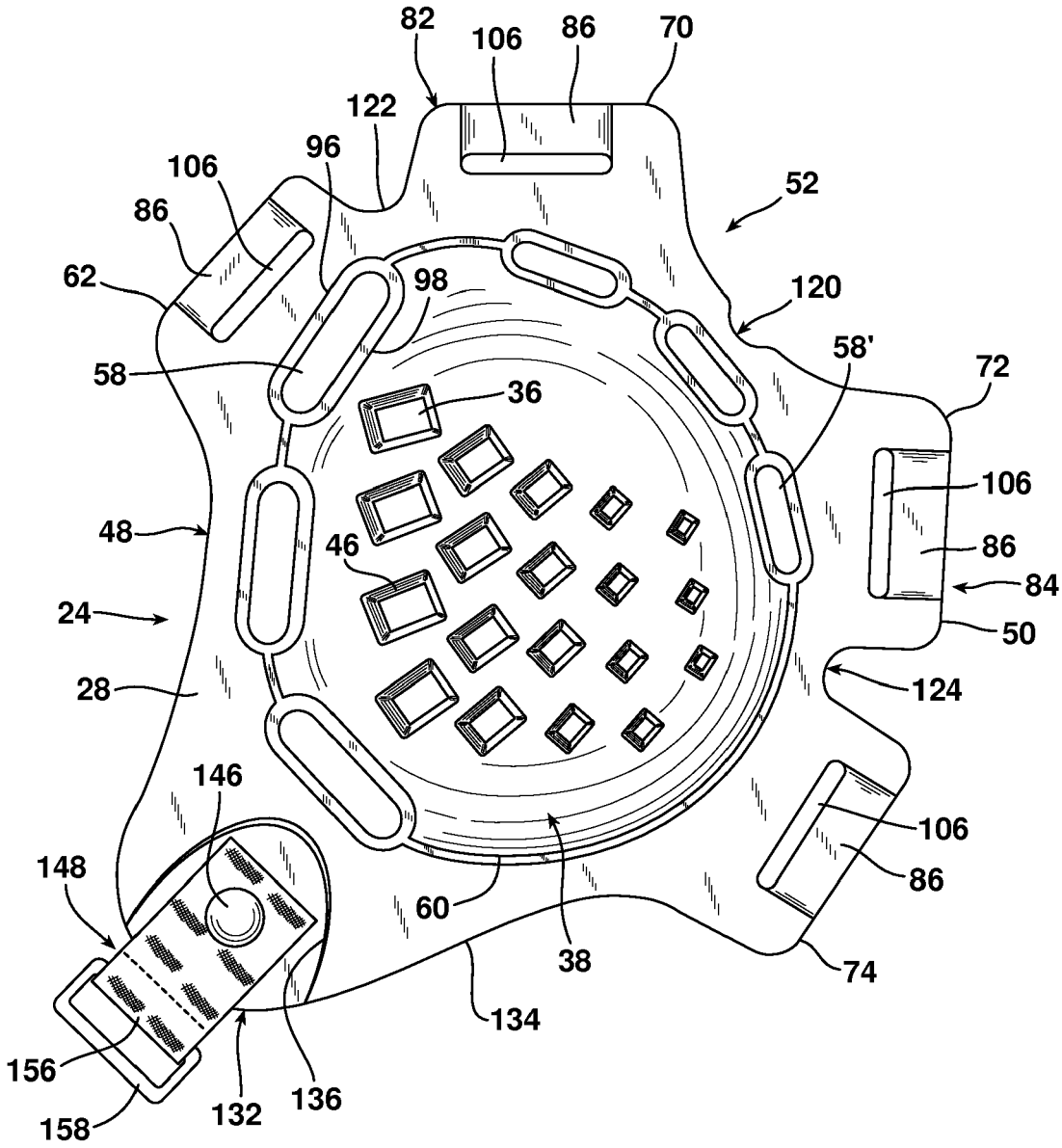
FIG. 9 is an outside plan view of the left earguard shell of FIG. 7.
Figure 10:
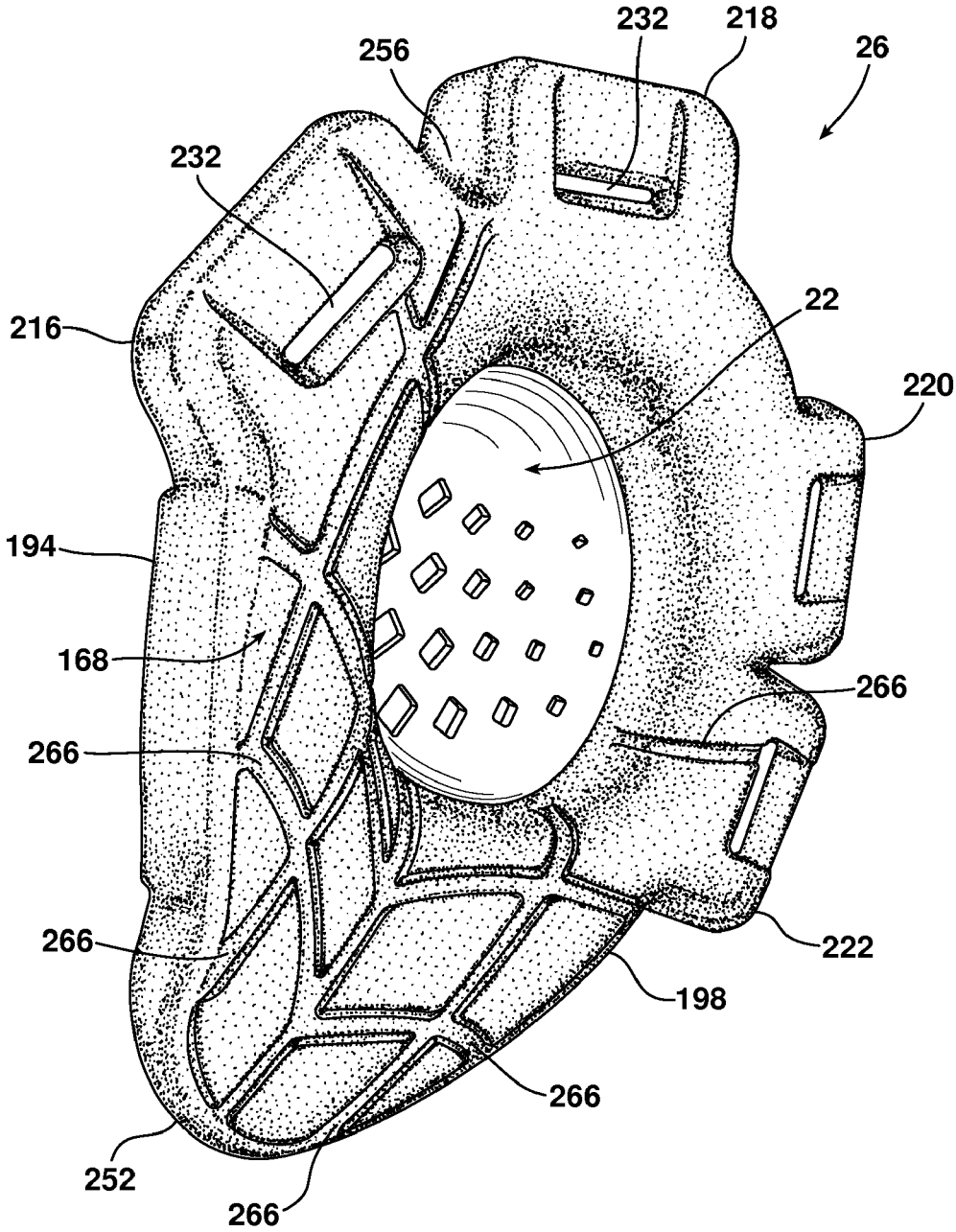
FIG. 10 is an inside perspective view of the right earguard of FIG. 1, with the straps removed for purposes of clarity.

Since the right and left ear protection shells are symmetrical, a detailed description of one of the shells, such as the left shell 24, is also applicable to the right shell 22. The left ear protection shell 24, as shown in FIGS. 7 and 9, has an exterior surface 28 and an interior surface 40. The shell 24 is formed with a generally inner concave and outer convex central portion 38 having a plurality of polygonal-shaped openings 36. The openings 36 are generally rectangular in shape with beveled edges 46 (FIGS. 7 and 9). The openings 36 vary in size with the larger openings located near a front portion 48 of the left shell 24, and gradually decrease in size toward a rear portion 50 of the left shell 24. The openings 36 provide ventilation and a sound transmission path to the ears of the wearer.

The left ear protection shell 24 also includes a plurality of elongated alignment openings 58 (FIGS. 7 and 9) located along the periphery 60 of the dome-shaped central portion 38. The alignment openings 58 include elongated parallel sides 96 and 98 (FIG. 7) and opposite rounded ends 108 and 112 (FIG. 7). Larger elongated openings 58 are generally located toward the front portion 48 of the shell 24 and smaller elongated openings 58' are located toward the back portion 50 of shell 24. The alignment openings enable the ear protection shell 24 to easily mate and align in a fixed stable position with the earguard pad 34.

The shell 24 also includes two generally rectangular alignment lobes 62 and 70 (FIGS. 7 and 9) with curved corners at a top portion 82 of the shell 24 and two generally rectangular alignment lobes 72 and 74 (FIGS. 7 and 9) at a rear portion 84 of the shell 24.

Each of the alignment lobes 62, 70, 72 and 74 at the exterior surface 28 of the shell 24 include a rectangular shaped depression 86. Each rectangular depression 86 includes a slot-shaped strap opening 106 (FIGS. 7 and 9) located at a base 94 (FIG. 7) of the depression 86. The width of the rectangular depression 86 is approximately the same as the width of the slot opening 106.

The shell 24 also includes a curved notch 120 (FIGS. 7 and 9) located in the upper rear portion 52 between the projecting lobes 70 and 72, a U-shaped recess 122 located between the lobes 62 and 70, and a U-shaped recess 124 located between the lobes 72 and 74.

The notch 120 and U-shaped recesses 122 and 124 help the right and left ear protection pads 26 and 34 to mate and align in a fixed stable position with the corresponding shells 22 and 24.

Figure 11:
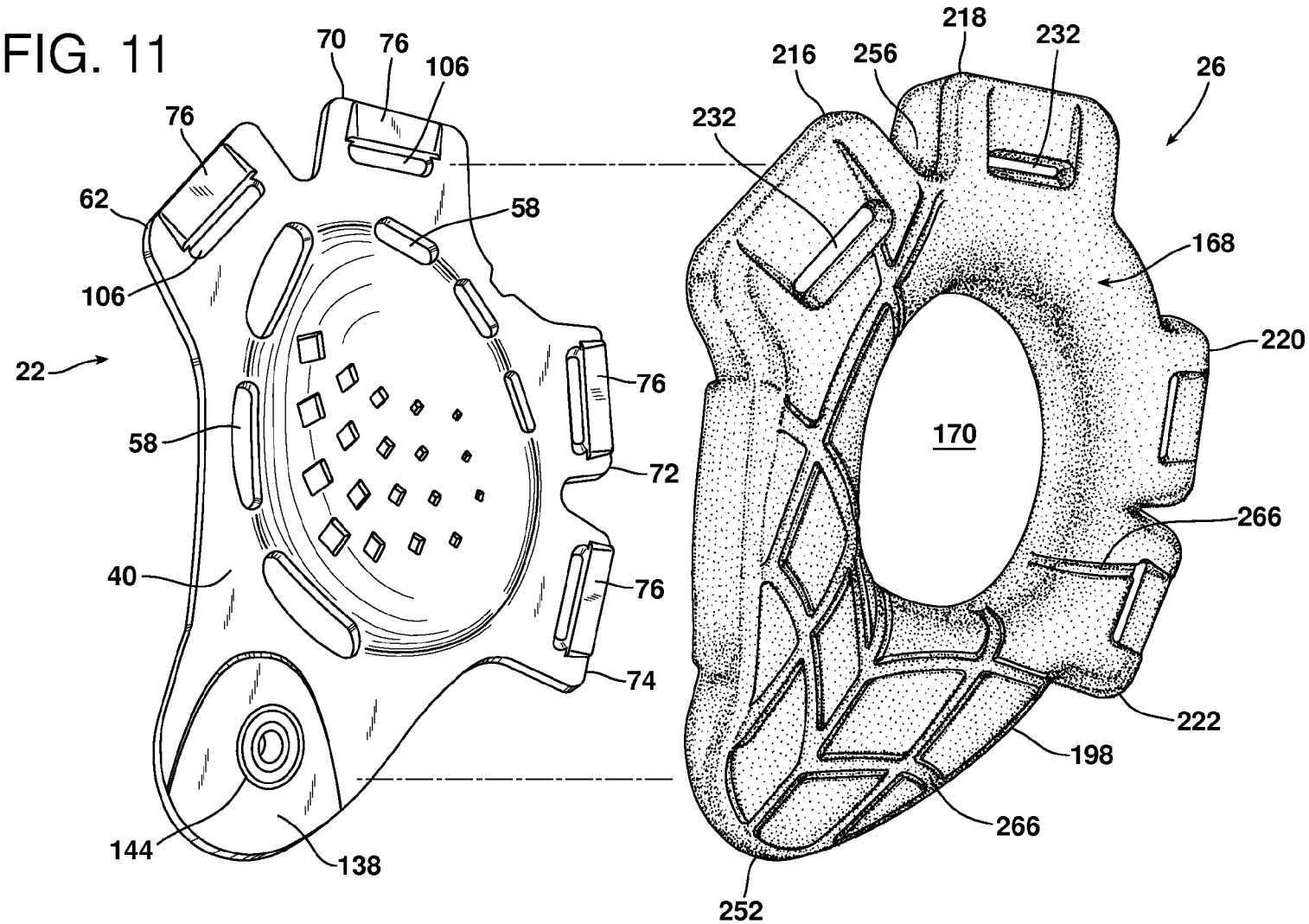
FIG. 11 is an exploded perspective view of the right earguard of FIG. 10.
Figure 12:
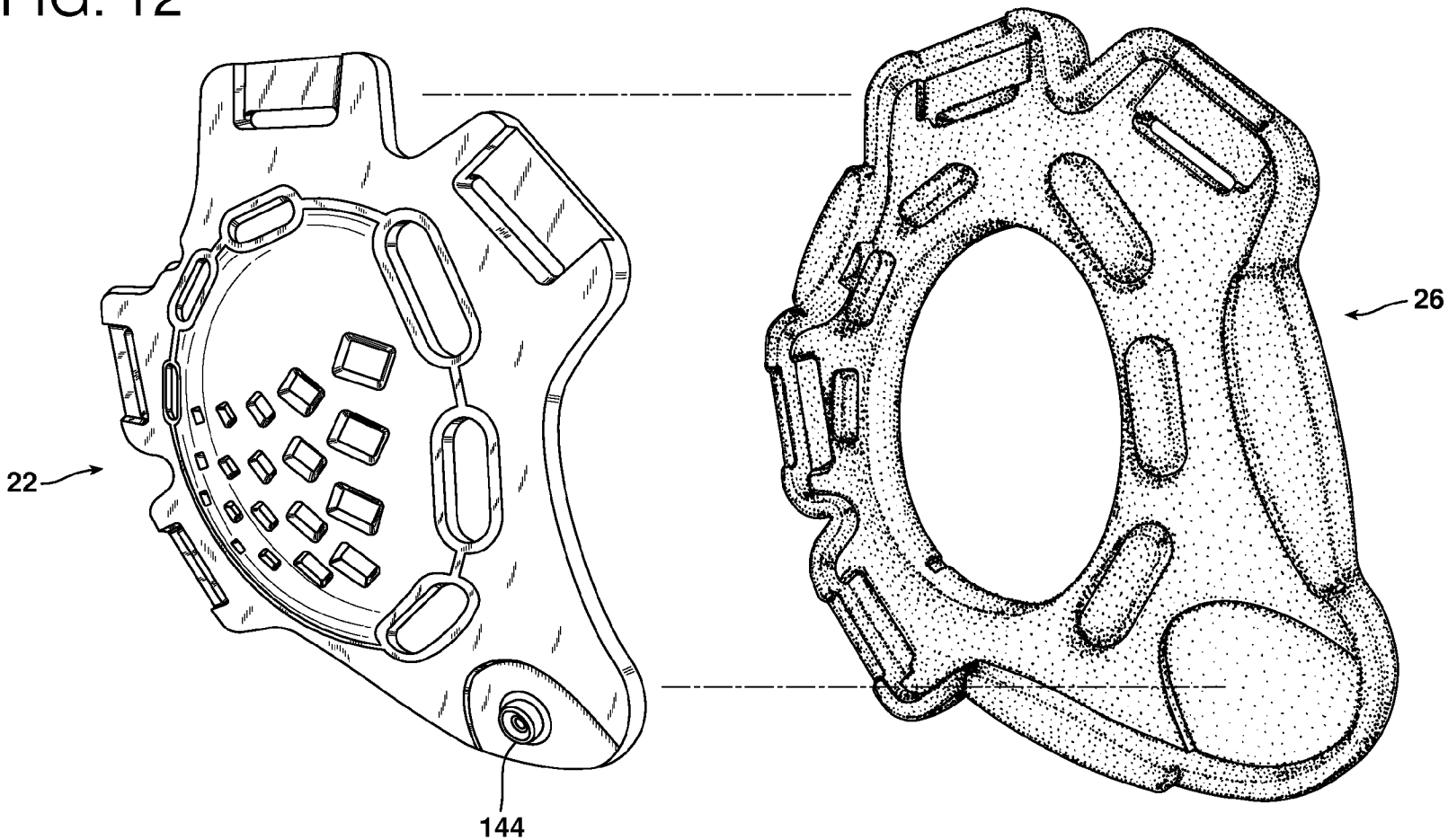
FIG. 12 is an exploded perspective view of the opposite side of the right earguard of FIG. 10.

A curved bottom portion 132 (FIGS. 7 and 9) of the shell 24 is located between the front portion 48 of the shell 24 and a lower portion 134 of the shell 24. A U-shaped depression 136 in the bottom portion 132 includes a fastening means, such as a snap attachment 144 (FIGS. 11 and 12). The snap attachment 144 connects to a releasable snap fastener 146 (FIGS. 7 and 9) provided at a top end of a chinstrap portion 148 (FIGS. 7 and 9). The chinstrap portion 148 includes a looped end 156 that loops around a connecting ring 158 such that the chinstrap portion 148 can rotate 360° when the snap fastener 146 engages the snap attachment 144.

Each of the lobes 62, 70, 72 and 74 at the interior surface 40 of the shell 24 (FIGS. 6 and 11) include a rectangular-shaped bulge 76 extending from the top of the lobes to the slot opening 106. The bulge 76 is approximately the same width as the slot opening 106. The bottom 132 (FIG. 6) at the interior surface of the shell 24 contains a U-shaped bulge 138 that corresponds to the U-shaped depression 136 (FIG. 7) on the exterior surface 28 of the shell 24. The back of the snap attachment 144 (FIG. 6) projects through a central portion of the U-shaped bulge 138.

Figure 5:
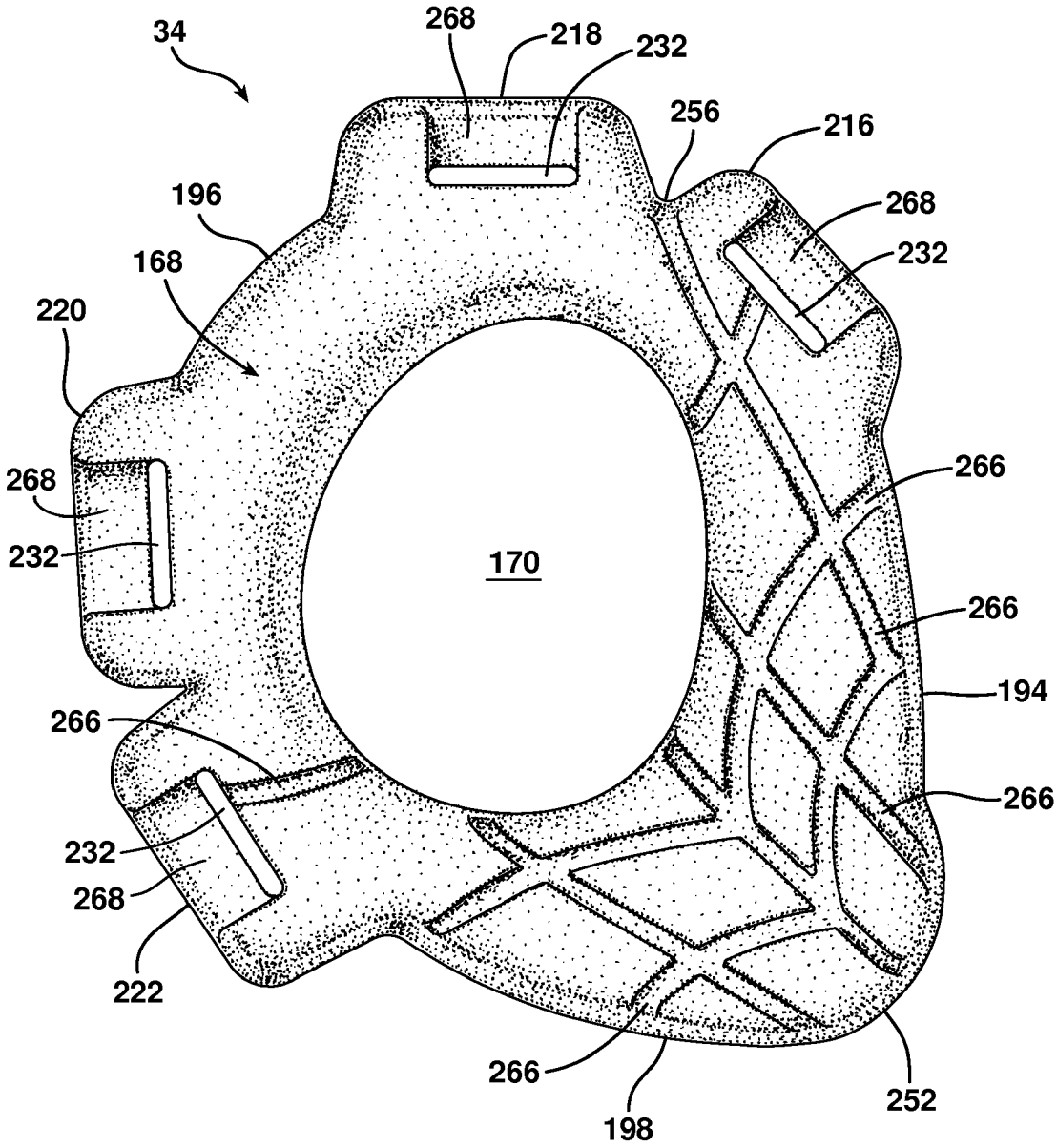
FIG. 5 is an inside plan view of the left earguard pad of FIG. 4 with the outside shell removed.

The left earguard pad 34 has an outside surface 160 (FIG. 7) and an inside surface 168 (FIG. 5). The earguard pad 34 has a generally circular or slightly elliptical central opening 170 that communicates with the central portion 38 of the shell 24 and the openings 36 contained therein.

The material forming the earguard pad 34 provides a generally soft cushion-like protection to the ears of the wearer of the headgear 10 while the inner concave, outer convex shell 24 that mates with the earguard pad 34 functions as a protective shield for the ear. The opening 170 in the earguard pad and the openings 36 in the ear protection shell 24 provide comfortable ventilation and permit sound transmission to the wearer of the headgear 10. The openings 170 and 36 also provide an escape path into the ambient air for perspiration that can develop around the ears during sports activity.

The earguard pad 34 further includes spaced alignment bosses 172 (FIG. 7) that project outwardly from the exterior side 160 of the pad 34 along a generally circular path close to the periphery 180 of the central circular opening 170 of the earguard pad 34. The alignment bosses 172 align with and project through the corresponding alignment openings 58 (FIG. 7) in the ear protection shell 24 when it is mated with the earguard pad 34 as shown in FIG. 1, and help provide a fixed and positionally stable assembly of the earguard pad 34 and the ear protection shell 24 in a predetermined alignment position as shown in FIGS. 1-3.

The earguard pad 34 also includes a front edge projection ridge 182 (FIG. 7) projecting from the outside surface 160 at a front portion 194 of the pad 34. The earguard pad 34 also includes a rear edge projection ridge 184 projecting from the outside surface 160 at an upper rear portion 196 of the pad 34, and a lower edge projection ridge 186 projecting from the outside surface 160 at a lower portion 198 of the earguard pad 34.

The rear edge projection ridge 184 also includes a relatively small semi-circular protuberance 206 (FIG. 7) that projects from an inside surface portion 208 of the projection 184.

Figure 3:
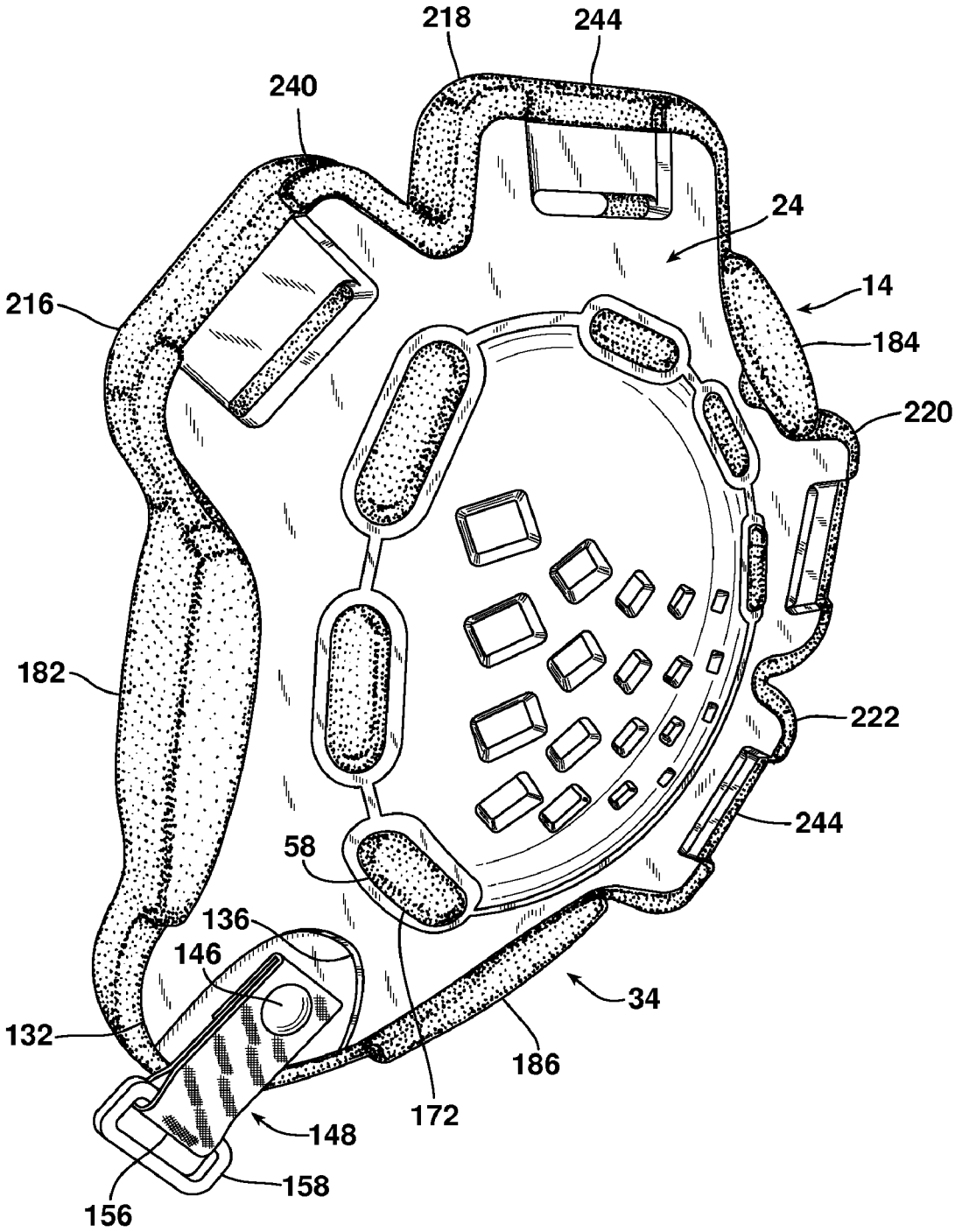
FIG. 3 is an outside perspective view of the left earguard of FIG. 2.

The projection ridges 182, 184 and 186 (FIG. 7) further enable the shell 24 to mate and align in a fixed stable position with the pad 34 by engaging against the complementary shaped front portion 48, rear portion 52, and lower portion 134 of the shell 24, to help maintain the predetermined alignment position of FIGS. 1-3. The protuberance 206 (FIG. 7) on the projection ridge 184 of the pad 34 provides additional alignment stabilization by engaging the curved notch 120 on the shell 24.

The left earguard pad 34 (FIG. 7) also include's lobes 216, 218, 220 and 222 with projecting wall portions 216*a*, 218*a*, 220*a*, and 222*a* that project from the periphery of the lobes 216, 218, 220 and 222 at the outside surface 160 of the earguard pad 34. The projecting wall portions 216*a*, 218*a*, 220*a* and 222*a* surround and engage and confine the complementary periphery of the lobes 62, 70, 72 and 74 of the ear protection shell 24 to align the earguard pad 34 and the ear protection shell 24 in the predetermined alignment position and assembly as shown in FIGS. 1-3.

It will be noted that the wall portions 216*a* and 218*a* are continuous at 256 (FIG. 7) and the wall portions 220*a* 222*a* are continuous at 264.

Under this arrangement the confinement of the ear protection shell lobes 62, 70, 72 and 74 within the projecting wall portions 216*a*, 218*a*, 220*a* and 222*a* help provide the fixed and positionally stable alignment position and assembly of the ear guard pad 34 and the ear protection shell 24 as shown in FIGS. 1-3.

Each of the lobes 216, 218, 220 and 222 include a rectangular shaped depression 230 (FIG. 7) with a slot opening 232 at the base 234 of the depression. Each depression 230 is approximately the same width as the slot openings 232. The slot openings 232 align with the corresponding slot openings 106 on the shell 24. The depressions 230 receive the bulges 76 (FIG. 6) when the shell 24 is mated and aligned with the pad 34. Under this arrangement the engagement between the bulges 76 of the ear protection shell 24 and the depressions 230 of the earguard pad 34 help maintain the fixed and positionally stable alignment position and assembly of the pad 34 and the shell 24.

Each of the lobes 216, 218, 220 and 222 (FIG. 7) have a cutout 244 in the projecting wall portions that aligns with and is approximately the same width as the slots 232 (FIGS. 2, 3 and 7)

A bottom portion 252 (FIG. 7) of the pad 34 includes a projecting wall portion 252*a* and an oval shaped depression 254. The projecting wall portion 252*a* surrounds, engages and contains the complementary periphery of bottom portion 132 of the ear protection shell 24. Such engagement between the bottom portion 132 of the shell 24 and the projecting wall portion 252*a* also help maintain the fixed and positionally stable assembly and alignment position of the pad 34 and shell 24.

Figure 6:
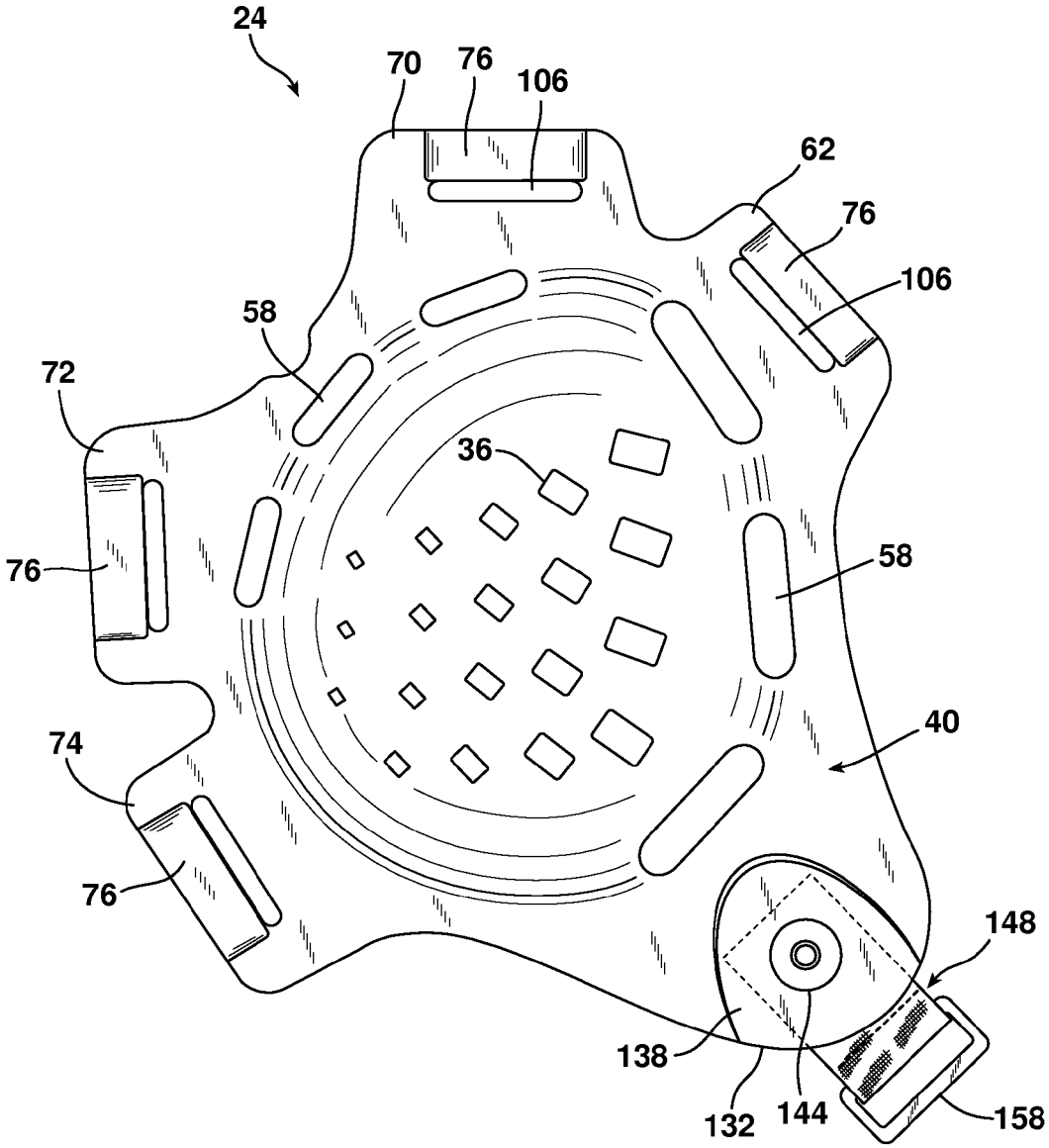
FIG. 6 is an inside plan view of the left earguard shell of FIG. 4 with the inside pad removed.

The depression 254 at bottom portion 252 receives the rear portion of the snap attachment 144 (FIG. 6).

Figure 4:
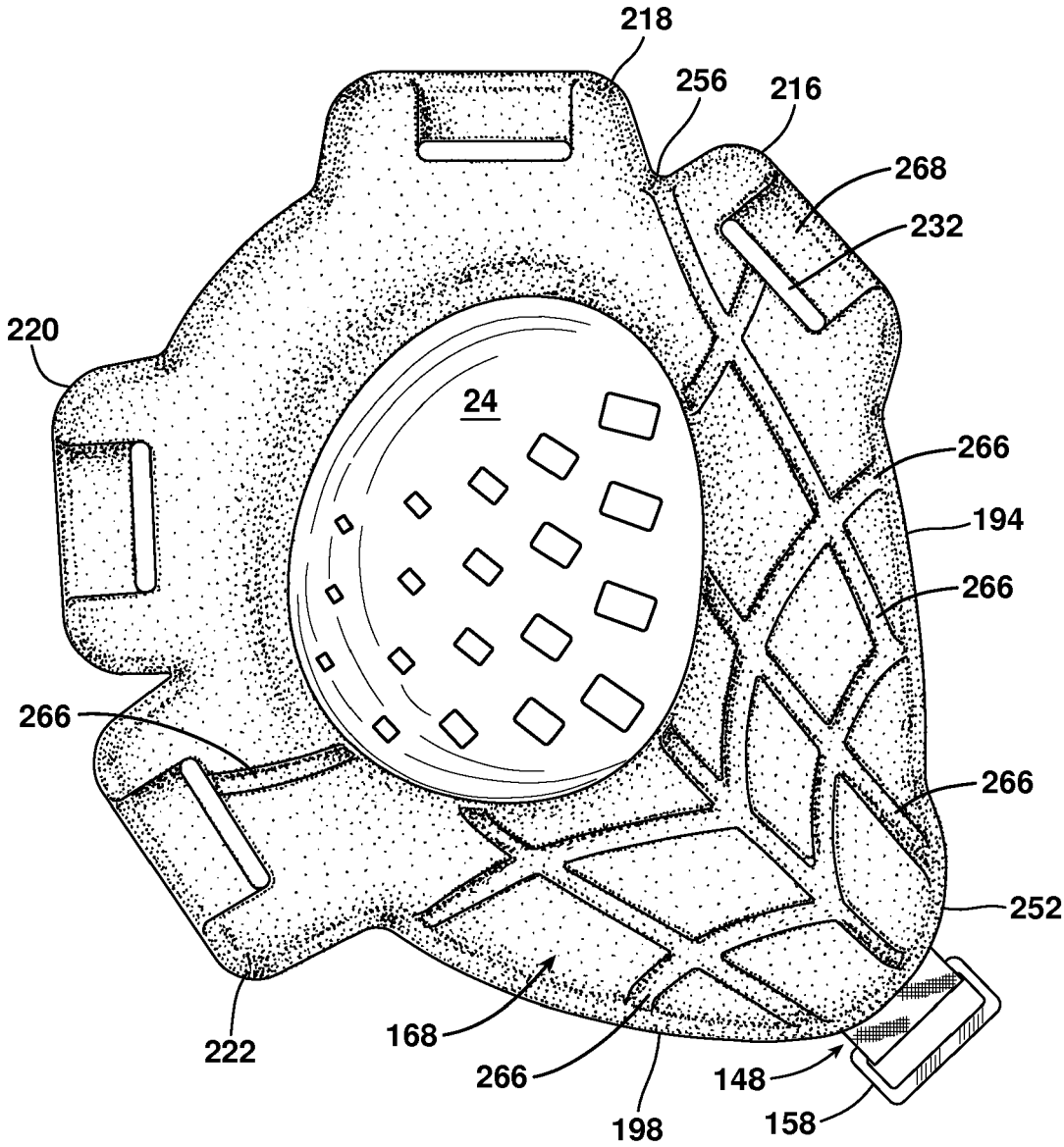
FIG. 4 is an inside plan view of the left earguard of FIG. 3.

As shown in FIGS. 4 and 5, the inner surfaces 168 of the earguard pads 26 and 34 are formed with a network of interconnected channels or conduits 266 that extend to the central opening 170 from the lobes 216 and 222, the U-shaped portion 256, the front portion 194, the bottom portion 252, and the lower portion 198, for communication with the central opening 170.

The network of conduits 266 (FIGS. 1 and 7) provide a drainage path for perspiration that can develop around the ears of the wearer of the headgear 10.

The lobes 216, 218, 220 and 222 (FIG. 5) at the inner surface 168 of the earguard pad 34 also include central rectangular-shaped depressions 268 extending from the top of the lobes to the slot openings 232. Each depression 268 is approximately the same width as the slot openings 232.

As shown in FIG. 1, the headgear 10 includes top lateral head straps 276 and 278 and rear lateral head straps 280 and 282. The straps 276, 278, 280 and 282 are used to join the right and left earguard shells 22 and 24 to the right and left earguard pads 26 and 34, to form the right and left earguards 12 and 14, and to connect the right and left earguards 12 and 14 together to form the headgear 10.

Each lateral head strap 276, 278, 280 and 282 has an upper surface 290 (FIG. 1), a lower surface 292, a right end portion 286 and a left end portion 288. The straps 276, 278, 280 and 282 permit selective adjustable connection of the right earguard 12 and the left earguard 14 to enable the headgear 10 to fit comfortably on the wearer's head.

It has been found that a head strap length of about 14 to 16 inches is suitable for most requirements. Each lateral head strap 276, 278, 280 and 282 is of substantially the same construction and therefore only the head strap 276 will be described in detail.

Figure 14:
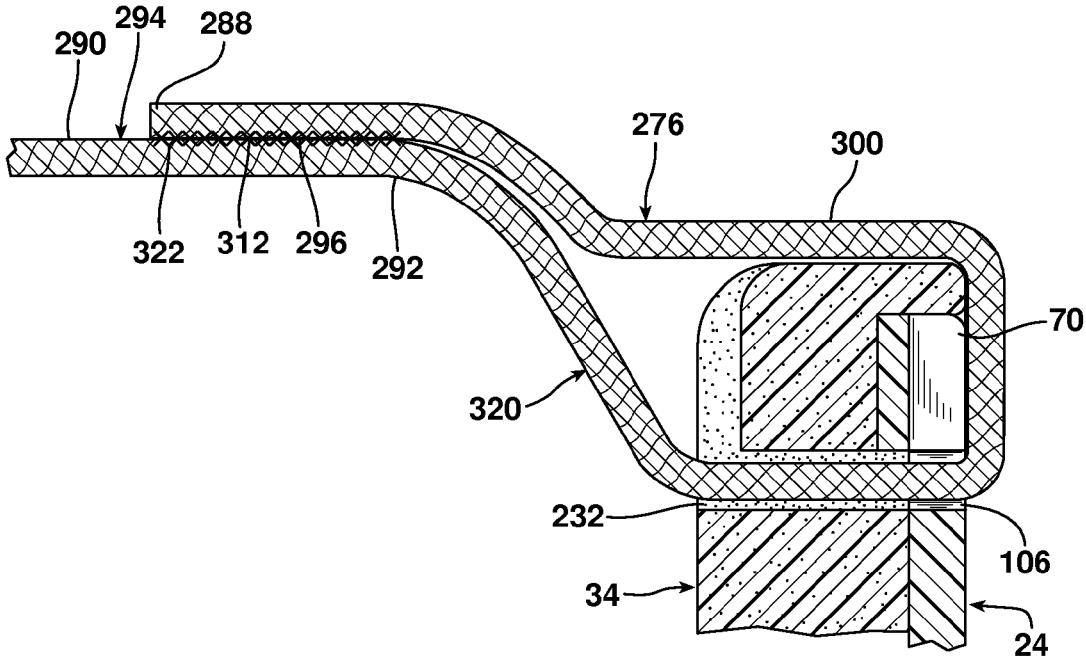
FIG. 14 is a sectional view taken on the line 14-14 of FIG. 2.

As shown in FIGS. 1 and 14, the upper surface 290 of the head strap 296 at the right end portion 286 is a relatively smooth surface 298 extending for a length of about 3½ to 4 inches. The relatively smooth upper surface portion 298 is contiguous with an upper surface portion 294 that has a loop type engagement fabric 322 such as the type sold under the trademark Velcro. The looped fabric portion 294 extends approximately 8 to 8½ inches where it is contiguous with a left end portion 288 of the strap 276 having its upper surface 290 covered with hook type fasteners 312 of the type sold under the trademark Velcro. The left end portion 288 with hook type fasteners extends approximately 3 to 3½ inches.

The lower surface 292 of the head strap 276 at the right end portion 286 is covered with the previously described hook type fasteners (not shown) that extend for a length of about 2 to 2½ inches. The hooked portion is contiguous with a strap portion 318 at the lower surface 292 covered with the loop type engagement fabric that extends for a length of about 3 to 3½ inches. The strap portion 318 at the lower surface 292 is contiguous with a strap portion 320 at the lower surface 292 that has a relatively smooth surface 300. The relatively smooth lower surface portion 300 extends approximately 10 to 10½ inches to the left end portion 288 of the strap 276.

Figure 13:
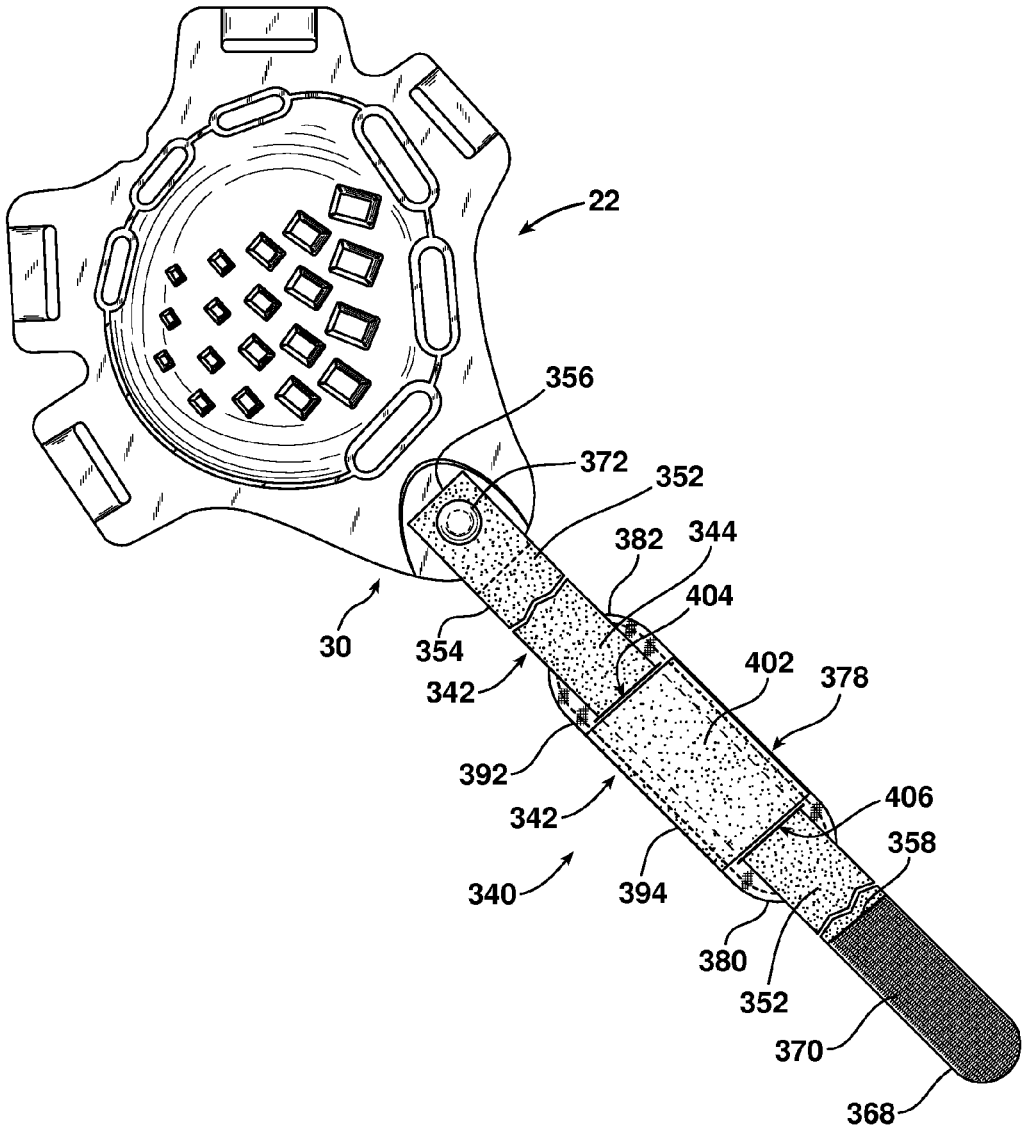
FIG. 13 is an outside plan view of the right earguard shell of FIG. 12 including the chin strap.

As shown in FIGS. 1 and 13, an adjustable chinstrap assembly 340 is provided at the bottom portion 30 of the right earguard 12 and the left earguard 14. The adjustable chinstrap assembly 340 includes a chinstrap portion 342 and a chinpad 378 and a chinstrap mate 148 (FIG. 1). The chinstrap 342 has an upper smooth textured surface (not shown) with a snap 372 (FIG. 13) at the right end 354. The snap 372 is a rotatable releasable fastener, that can rotate 360° when the snap fastener 372 engages the snap attachment 144 (FIGS. 12 and 13). The chinstrap portion 342 includes a lower surface 344 with hook engagement means 352 extending from a right end 356 (FIG. 13) of the chinstrap portion 342 to a border 358 of a left end portion 368 (FIG. 13) covered with hook engagement means 370.

The chinpad 378, (FIGS. 1 and 13) with semicircular end portions 380 and 382, has an upper padded layer 390 (FIG. 1) joined to a lower layer 392. The lower layer 392 has slotted openings 404 and 406 slightly inward of the end portions 380 and 382, and a middle portion 394 between the slotted openings 404 and 406 covered with loop-type engagement means 402.

The chinpad 378 (FIGS. 1 and 13) is thus enabled to adjustably slide along the chinstrap 342 through the slotted openings 404 and 406 on the chinpad 378 such that the upper padded layer 390 can be aligned with the chin of the wearer.

As shown in FIGS. 1 and 13 the right end portion 354 of the adjustable chinstrap 340 is attached to the right earguard 12 by engaging the pivoting snap fastener 372 (FIG. 13) with the snap attachment means 144 (FIG. 12).

The left end portion 368 (FIG. 13) of the chinstrap 340 is adjustably attached to the left earguard 14 via the chinstrap mate 148 by looping the end portion 368 through the connecting ring 158 (FIG. 1) so that the hook engagement means 370 adjustably engages with the loop-type engagement means 352 and/or 402 (FIG. 13).

As shown in FIGS. 1, 2 and 3, the connecting ring 158 of the chinstrap mate 148 is attached to the chinstrap mate 148 by means of the looped end 156. The snap fastener 146 contained in the chinstrap mate 148 engages the snap attachment (not shown) to thereby connect the chinstrap assembly 340 to the bottom portion 30 of the right earguard 12 and the left earguard 14.

As shown in FIGS. 1, 11 and 12, the headgear 10 is assembled by mating the right plastic ear protector 22 with the right earguard pad 26 to form the right earguard 12. In similar fashion, the left earguard 14 is formed by mating the left plastic ear protector 24 with left earguard pad 34 to form the left earguard 14 (FIGS. 1, 2, 3 and 7). The slot openings 106 (FIG. 7) in lobes 62, 70, 72 and 74 of the ear protectors 22 and 24 (FIG. 1) align and overlap with the slot openings 232 in lobes 216, 218, 220 and 222 of the earguard pads 26 and 34.

The headgear 10 is then assembled as shown in FIG. 1 by inserting the lateral straps 276, 278, 280 and 282 through the aligned slot openings 106 in the shells 24 and 22 (FIG. 2) and 232 in the pads 26 and 34 of the earguards 12 and 14, and adjustably fastening the opposite end portions 296 and 298 (FIG. 1) of the lateral straps to fit the individual wearer.

Figure 8:
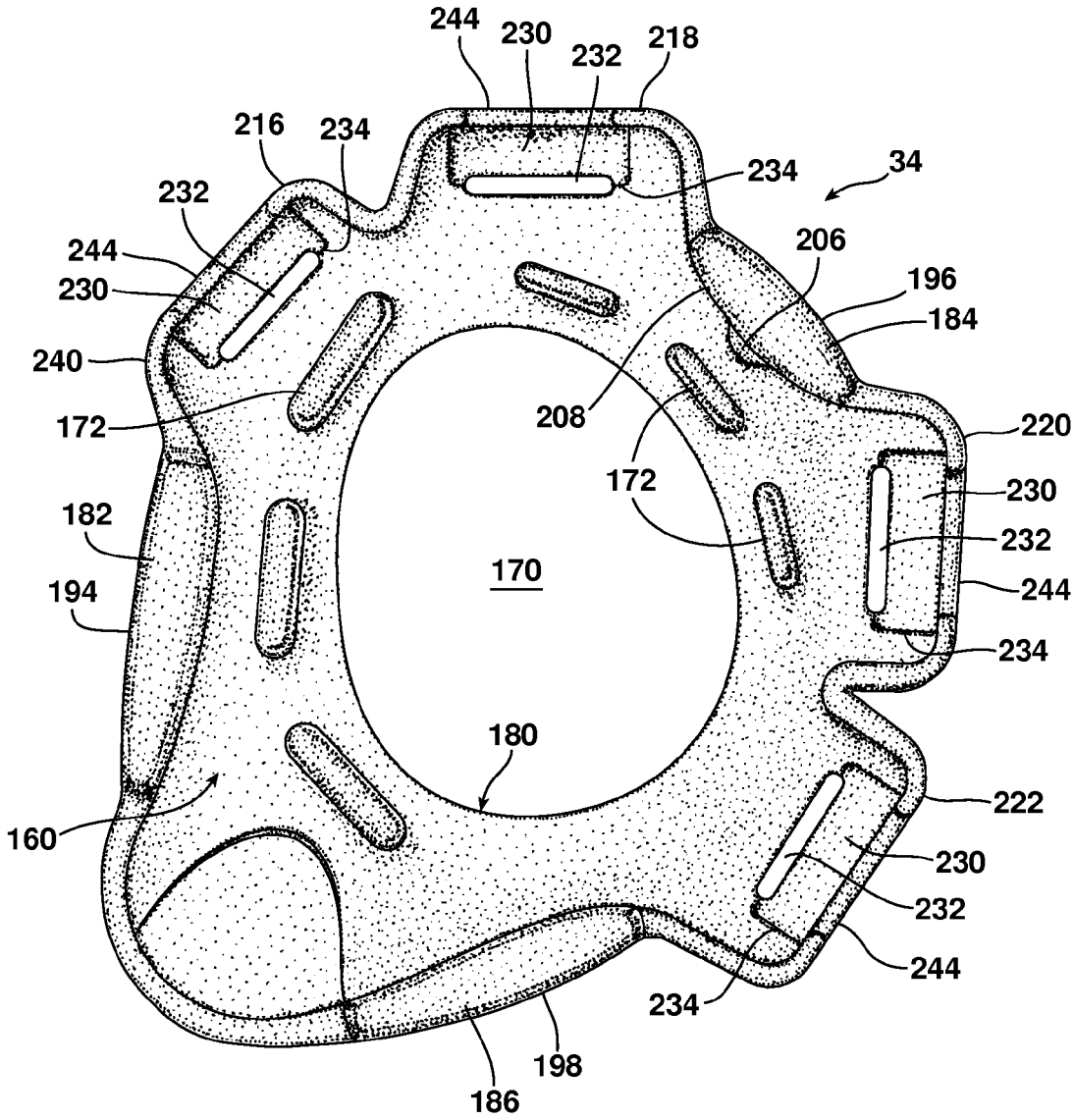
FIG. 8 is an outside plan view of the left earguard pad of FIG. 7.

As shown in FIGS. 1, 2, 7, 8 and 14, the left end portion 288 of lateral head strap 278 is initially passed through the slotted opening 232 (FIGS. 7 and 8) of left earguard pad 34 and then into the aligned slot opening 106 of left earguard shell 24 (FIGS. 7 and 8). The head strap 278 is then looped over the top of the aligned projecting lobes 70 (on shell 24) and 218 (on pad 34) to adjustably engage the loop fasteners 312 with the woven fabric 322 on the strap portion 294 of the lateral strap 278 (FIG. 14).

The right end portion 286 of the lateral head strap 278 is initially passed through the slotted openings 76 of the right earguard shell 22 and then into the aligned slot openings 232 of the right earguard pad 26. The end portion 286 of head strap 278 is then pressed upwardly against the under surface 292 of the strap 278 to complete the assembly of the strap 278 to the right and left earguard assemblies 12 and 14.

A similar procedure is used to adjustably attach the remaining head straps 276, 280 and 282 to the right earguard 12 and left earguard 14 to assemble the headgear 10.

Assembly of the straps 276, 278, 280 and 282 to the earguards 12 and 14 helps maintain the alignment position of the mated pad 26 and shell 22 of each earguard 12 and 14.

As shown in FIGS. 1 and 7, the plurality of alignment openings 58 and 58' on the earguard shell 24 align with and overlap the alignment bosses 172 on the earguard pad 34, such that the alignment bosses 172 are received in the alignment openings 58 to facilitate and enhance the positioning of the earguard pad and the earguard shell in the positionally stable alignment position of the earguard shell 24 with the earguard pad 34, to form the left earguard 14. An identical structural arrangement exists on the right earguard shell 22 and the right earguard pad 26 to facilitate the positionally stable mating of the shell 22 with the pad 26 to form the right earguard 12.

As shown in FIGS. 1, 7 and 8, the wall 240 that projects upwardly around the periphery 242 of the earguard pad 34 outlines the periphery 244 of the earguard shell 24 to enhance the positionally stable confinement of the left earguard shell 24 in the left earguard pad 34. An identical structural arrangement exists on the right earguard shell 22 and the right earguard pad 26 to facilitate the postionally stable mating of the shell 22 with the pad 26 to form the right earguard 12.

Also, as shown in FIGS. 1 and 7, the border projections 182, 184 and 186 on the earguard pad 24 provide easily accessible locations for the front 48, the back 50, the upper rear 52 and the lower portion 134 of the shell 24 to engage with and mate with the earguard pad 34 to form the positionally stable assembly of the left earguard 14. An identical structural arrangement exists on the right earguard pad 26 and the right earguard shell 22 to facilitate the positionally stable mating of the right shell 22 with the pad 26 to form the right earguard 12.

As various changes can be made in the above constructions and methods without departing from the scope of the invention, it is intended that all matter contained in the above description or shown in the accompanying drawings shall be interpreted as illustrative and not in a limiting sense.

What is claimed is:

1. A headgear comprising:

a right earguard assembly and a left earguard assembly that are symmetrical, each of the right earguard assembly and the left earguard assembly comprising an inner earguard pad and an outer protective shell that is detachable from the inner earguard pad;

a plurality of elongated straps extending from one of the left earguard assembly and the right earguard assembly to the other earguard assembly, the plurality of elongated strips being detachably joined to the right and left earguard assemblies to prevent unintentional detachment of the inner earguard pad and the outer protective shell of each earguard assembly, the protective shell having a peripheral shape including a first corresponding plurality of peripheral lobes, the earguard pad being formed with a second corresponding plurality of lobe-like peripheral wall portions that surround and embrace the peripheral lobes of the protective shell to align the respective outer protective shells on the respective earguard pads in respective alignment positions, the earguard pad comprising a circular opening, the earguard pad adjacent to a periphery of the circular opening comprising alignment bosses configured to be coupled to alignment openings around a periphery of a central portion of the protective shell, the central portion including a plurality of openings that gradually decrease in size towards a rear of the respective earguard assembly.

2. The headgear of claim 1, wherein:

the straps are configured to be adjusted, the straps maintaining selected individual lengths of the respective straps between the right and left earguard assemblies;

the circular opening in the earguard pad is configured to allow an ear of a user to pass-through; and the plurality of openings in the central portion of the protective shell comprise one or more beveled edges.

3. The headgear of claim 1, wherein the protective shell is provided with an opening in the peripheral lobe and said earguard pad is formed with corresponding openings that align with the openings in the protective shell when the protective shell and the earguard pad are in the respective alignment positions.

4. The headgear of claim 1, wherein each respective protective shell includes peripheral sections that extend between selected pairs of peripheral lobes, each respective earguard pad including supplemental wall portions that engage the peripheral sections of the respective protective shells when the respective protective shells and the respective earguard pads are in the respective aligned positions, to enhance the positional stability of the protective shells on the earguard pads in the respective aligned positions.

5. The headgear of claim 1, wherein at least one of the earguard pads include supplemental wall portions that engage the periphery of at least one of the protective shells between selected pairs of peripheral lobes on the at least one protective shell.

6. The headgear of claim 3, wherein the straps have opposite ends and an upper surface and an under surface, the straps including a first hook and loop fastening apparatus at the under surface of the strap such that entry of one end of one strap initially through the shell opening and then into the earguard opening of one of the earguard assemblies permit hook and loop attachment at the under surface of the one strap, the one strap further including a second hook and loop fastening apparatus at the upper surface of the strap such that entry of an opposite end of the one strap initially through the earguard pad opening and then into the shell opening of the other earguard assembly permit hook and loop attachment at the upper surface of the one strap.

7. The headgear of claim 1, wherein each earguard pad has an inner surface and an inner surface outer periphery, the inner surface of the earguard pads being formed with channels extending from the openings in the earguard pads to the inner surface outer periphery of the earguard pads, to accommodate the straps.

8. The headgear of claim 1, wherein each protective shell has an outer surface and the peripheral lobes have a radially outer peripheral edge, the outer surface being formed with channels that extend from the openings in the peripheral lobes to the radially outer peripheral edge to accommodate the straps.

9. The headgear of claim 8, wherein each earguard pad has a channel formed in the lobe-like peripheral wall portions in alignment with the channels in the outer surface of the protective shells.

10. The headgear of claim 1, wherein each earguard pad has an outer surface formed with a select number of spaced alignment bosses that protrude outwardly from the outer surface and each protective shell includes a corresponding number of openings aligned with the respective alignment bosses to receive the alignment bosses when the respective outer protective shells and the respective earguard pads are in their respective alignment positions to enhance the positional stability of the protective shell on the earguard pad in the aligned position.

11. A headgear comprising:

a right earguard assembly and a left earguard assembly that are symmetrical, each earguard assembly comprising an inner earguard pad and an outer protective shell detachable from each other, a plurality of elongated straps extending from one of the earguard assemblies to the other earguard assembly detachably joined to each earguard assembly to prevent unintentional detachment of the inner earguard pad and the outer protective shell of each earguard assembly, the protective shell having an asymmetric peripheral shape, and the earguard pad being formed with an asymmetric peripheral wall of complementary shape and size with respect to the asymmetric peripheral shape of the protective shell such that the asymmetric peripheral wall of the earguard pad surrounds and embraces the asymmetric periphery of the protective shell to align the earguard pad and protective shell in the earguard assembly, the earguard pad comprising a circular opening, the earguard pad adjacent to a periphery of the circular opening comprising alignment bosses configured to be coupled to alignment openings around a periphery of a central portion of the protective shell, the central portion including a plurality of openings that gradually decrease in size towards a rear of the respective earguard assembly.

12. The headgear of claim 11, wherein each protective shell and each earguard pad are provided with a corresponding plurality of slot-like openings that respectively align when the protective shell and the earguard pad are in their aligned positions in the earguard assembly.

13. The headgear of claim 11, wherein the straps have opposite ends and an upper surface and an under surface and include a first set of hook and loop fastening apparatus at the under surface of the strap such that entry of one end of one strap initially through the shell slot and then into the earguard slot of one of the earguard assemblies permit hook and loop attachment at the under surface of the one strap, the one strap further including a second set of hook and loop fastening apparatus at the upper surface of the strap such that entry of an opposite end of the one strap initially through the earpad slot and then into the shell slot of the other earguard assembly permit hook and loop attachment at the upper surface of the one strap.

14. The headgear of claim 11, wherein the protective shell includes a plurality of peripheral lobes corresponding to the plurality of straps and the earguard pad is formed with a corresponding plurality of lobe-like peripheral wall portions that surround and embrace the peripheral lobes to align the outer protective shell on the earguard pad in a alignment position, wherein each protective shell has an outer surface and the peripheral lobes have a radially outer peripheral edge, the outer surface being formed with channels that extend from the slot-like openings in the peripheral lobes to the radially outer peripheral edge to accommodate the straps.

15. The headgear of claim 14, wherein each earguard pad has an inner surface and an inner surface outer periphery, the inner surface of the earguard pads being formed with channels extending from the slot-like openings in the earguard pads to the inner surface outer periphery of the earguard pads, to accommodate the straps.

16. The headgear of claim 14, wherein each earguard pad has a channel formed in the lobe-like peripheral wall portions in alignment with the channels in the outer surface of the protective shells.

17. The headgear of claim 14, wherein the protective shells include peripheral sections that extend between selected pairs of peripheral lobes and the earguard pads include supplemental wall portions that respectively engage the peripheral sections of the respective protective shells when the protective shells of the earguard pad are in their aligned position, to enhance the positional stability of the protective shell on the earguard pad in the aligned position.

18. The headgear of claim 11, wherein each earguard pad has an outer surface formed with a select number of spaced alignment bosses that protrude outwardly from the outer surface and each protective shell includes a corresponding number of openings aligned with the respective alignment bosses to receive the alignment bosses when the respective outer protective shells and the respective earguard pads are in their respective alignment positions to enhance the positional stability of the protective shell on the earguard pad in the aligned position.

19. A system comprising:

at least one earguard pad, a periphery of the earguard pad forming an asymmetric shape, the earguard pad including a central circular opening configured to allow an ear to pass-through, the earguard pad adjacent to a periphery of the central circular opening including alignment bosses; and a shell configured to be coupled to the earguard pad, a periphery of the shell forming the asymmetric shape, the shell including a central dome-shaped portion, a periphery of the central dome-shaped portion configured to overlay on the periphery of the central circular portion of the earguard pad, the shell adjacent to the periphery of the dome-shaped central portion including alignment openings configured to be coupled to the alignment bosses, the dome-shaped portion including a plurality of openings that gradually decrease in size towards a rear of the shell.

20. The system of claim 19, wherein one or more openings of the plurality of openings comprise at least one beveled edge.

* * * * *